US008342900B2

(12) United States Patent
Kane et al.

(10) Patent No.: US 8,342,900 B2
(45) Date of Patent: Jan. 1, 2013

(54) APPARATUS FOR CIRCULATING GLITTER PARTICLES

(75) Inventors: Erika Kane, San Pedro, CA (US); Andrew Lourits, Los Angeles, CA (US); James A. Molina, Riverside, CA (US); Ben Yip, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 101 days.

(21) Appl. No.: 12/829,839

(22) Filed: Jul. 2, 2010

(65) Prior Publication Data

US 2012/0003898 A1 Jan. 5, 2012

(51) Int. Cl.
*A63H 33/04* (2006.01)
*A63H 33/40* (2006.01)

(52) U.S. Cl. ..... 446/75; 446/178; 40/410; 472/134

(58) Field of Classification Search ..... 446/71–75, 446/178–179, 218–219; 472/59, 61, 63, 472/134, 136, 137; 40/406, 407, 409, 410, 40/442, 443, 540
See application file for complete search history.

(56) References Cited

U.S. PATENT DOCUMENTS

| | | | | |
|---|---|---|---|---|
| 3,675,362 | A | | 7/1972 | de Gelder et al. |
| 3,731,421 | A | | 5/1973 | Frattolillo et al. |
| 4,165,579 | A | | 8/1979 | Chase |
| 4,215,500 | A | | 8/1980 | Sharp |
| 4,641,445 | A | | 2/1987 | Rossi |
| 4,955,412 | A | | 9/1990 | Younts et al. |
| 4,993,986 | A | | 2/1991 | Bloomfield |
| 5,015,211 | A | | 5/1991 | Reveen |
| 5,149,290 | A | | 9/1992 | Reveen |
| 5,209,694 | A | | 5/1993 | Utt, Jr. |
| 5,291,674 | A | * | 3/1994 | Torrence ..... 40/410 |
| 5,442,869 | A | | 8/1995 | McDarren et al. |
| 5,491,916 | A | | 2/1996 | Ingram et al. |
| 5,582,532 | A | | 12/1996 | Tucker |
| 5,632,419 | A | | 5/1997 | Pickens |
| 5,666,750 | A | | 9/1997 | Segan et al. |
| 5,794,944 | A | * | 8/1998 | Roberts ..... 273/447 |
| 5,919,078 | A | | 7/1999 | Cassidy |
| 6,048,422 | A | | 4/2000 | Kim, II et al. |
| 6,065,969 | A | | 5/2000 | Rifkin et al. |
| 6,149,495 | A | | 11/2000 | Austin et al. |
| 6,227,930 | B1 | | 5/2001 | Norman et al. |
| 6,260,989 | B1 | | 7/2001 | Ingraselino |
| 6,345,457 | B1 | | 2/2002 | Bradley |
| 6,468,126 | B1 | | 10/2002 | Herber |
| 6,739,876 | B2 | * | 5/2004 | Ochi ..... 434/258 |
| 6,796,872 | B2 | | 9/2004 | Herber |

(Continued)

FOREIGN PATENT DOCUMENTS

| | | | |
|---|---|---|---|
| CN | 1231937 | A | 10/1999 |

(Continued)

*Primary Examiner* — Kien Nguyen
(74) *Attorney, Agent, or Firm* — Edell, Shapiro & Finnan LLC

(57) ABSTRACT

A glitter circulation device includes a housing defining a chamber configured to receive a doll. A tray is coupled to the housing and configured to hold a plurality of glitter particles. A fan is coupled to housing and in communication with the tray and the chamber. The fan is configured to draw the glitter particles from the tray and expel the glitter particles into the chamber.

17 Claims, 10 Drawing Sheets

U.S. PATENT DOCUMENTS

| | | | | |
|---|---|---|---|---|
| 6,929,552 | B1 * | 8/2005 | Hargabus | 472/61 |
| 7,040,050 | B2 | 5/2006 | Skinner | |
| 7,093,949 | B2 | 8/2006 | Hart et al. | |
| 7,188,443 | B2 | 3/2007 | Collida et al. | |
| 7,197,841 | B2 | 4/2007 | Hsu et al. | |
| 7,207,497 | B2 | 4/2007 | Clark | |
| 7,311,580 | B2 | 12/2007 | Moomaw | |
| 7,311,610 | B2 * | 12/2007 | Ochi | 472/134 |
| 7,448,932 | B2 | 11/2008 | Buckley et al. | |
| 7,513,009 | B1 | 4/2009 | Strawn | |
| 8,206,232 | B2 * | 6/2012 | Johnston | 472/137 |
| 2002/0009948 | A1 | 1/2002 | Woods | |
| 2003/0041490 | A1 | 3/2003 | Dott et al. | |
| 2004/0092205 | A1 | 5/2004 | Woods | |
| 2005/0022834 | A1 | 2/2005 | Hwang | |
| 2005/0130554 | A1 | 6/2005 | Isenberg | |
| 2005/0186881 | A1 | 8/2005 | Gatto | |
| 2005/0239367 | A1 | 10/2005 | Fernandez, Jr. | |
| 2005/0277358 | A1 | 12/2005 | Isenberg | |
| 2006/0283060 | A1 | 12/2006 | Moomaw | |
| 2006/0283061 | A1 | 12/2006 | Moomaw | |
| 2006/0283062 | A1 | 12/2006 | Moomaw | |
| 2006/0286512 | A1 | 12/2006 | Cogliano et al. | |
| 2007/0026761 | A1 | 2/2007 | Moomaw | |
| 2007/0234604 | A1 | 10/2007 | Hsu | |
| 2007/0249261 | A1 | 10/2007 | Norman | |
| 2008/0016733 | A1 | 1/2008 | Tamamori | |
| 2008/0108278 | A1 | 5/2008 | Carpenter et al. | |
| 2008/0160876 | A1 | 7/2008 | Hsu | |
| 2009/0183746 | A1 | 7/2009 | Yue | |
| 2009/0263766 | A1 | 10/2009 | Ozuna et al. | |
| 2009/0269544 | A1 | 10/2009 | Morrison | |

FOREIGN PATENT DOCUMENTS

| | | |
|---|---|---|
| GB | 2249858 | 5/1992 |

* cited by examiner

APPARATUS FOR CIRCULATING GLITTER PARTICLES

FIELD OF THE INVENTION

The present invention relates to an apparatus for circulating glitter throughout a chamber configured to removably receive a doll.

BACKGROUND OF THE INVENTION

Various dolls with clothing and accessories are known. Some dolls include removable clothing or accessories, such as shoes or purses, so that the doll's outfit may be selected and changed by a child. Playsets including toy wardrobes for retaining such accessories and clothing are also known. However, conventional dolls and playsets provide limited possibilities for reconfiguring the appearance of a doll or other toy.

SUMMARY OF THE INVENTION

The present invention is directed to an apparatus for circulating glitter particles. The apparatus includes a housing defining a chamber and an opening in communication with the chamber. The chamber is configured to removably retain a toy therein. A door is coupled to the housing and movable between an open position allowing access to the chamber and a closed position restricting access to the chamber. The toy is passable through the opening and receivable in the chamber when the door is in the open position. A circulation mechanism is in communication with the chamber and configured to circulate glitter particles throughout the chamber in operation. In one implementation, the circulation mechanism is inoperable when the door is in the open position.

In one embodiment, the apparatus includes a tray coupled to the housing. The tray is configured to retain a plurality of the glitter particles. The glitter particles are moved from the tray and throughout the chamber via operation of the circulation mechanism.

In one embodiment, the toy includes an adhesive surface portion. At least a portion of the glitter particles contact the toy when circulated throughout the chamber. The glitter particles are adherable to the adhesive surface portion as the glitter particles circulate throughout the chamber.

In one embodiment, a retaining clip is coupled to the housing and disposed within the chamber. The retaining clip is configured to releasably secure the toy within the chamber.

The present invention is also directed to a glitter circulation device. The device includes a housing defining a chamber configured to receive a doll. A tray is coupled to the housing and configured to hold a plurality of glitter particles. A fan is coupled to the housing and in communication with the tray and the chamber. The fan is configured to draw the glitter particles from the tray and expel the glitter particles into the chamber.

In one embodiment, the housing defines an opening in communication with the chamber. A door is coupled to the housing and movable between an open position allowing access to the chamber and a closed position restricting access to the chamber. The doll is removably receivable in the chamber through the opening when the door is in the open position. In one implementation, the device further includes a switch in communication with the fan. The fan is operable when the switch is actuated and inoperable when the switch is de-actuated. The switch is actuated when the door is in the closed position and the switch is de-actuated when the door is in the open position.

In one embodiment, the fan is disposed in between the tray and the chamber. The glitter particles are drawn upwardly from the tray and into the chamber and circulated throughout the chamber via operation of the fan.

In one embodiment, the tray is slidably coupled to the housing. The tray is movable between an open position spaced from the fan and a closed position in communication with the fan. In one implementation, the fan is inoperable when the tray is in the open position.

The present invention also relates to a playset including a toy having an adhesive surface portion and a base defining a receptacle configured to removably receive the toy. In one implementation, the adhesive surface portion is releasably securable to the toy at a selected position. A circulation mechanism is coupled to the base and in communication with the receptacle. The circulation mechanism is operable to circulate particles throughout the receptacle. At least a portion of the particles adhere to the adhesive surface portion when the toy is received in the receptacle and the circulation mechanism is operating.

In one embodiment, a door is pivotally coupled to the base. The door is movable between an open position allowing access to the receptacle and a closed position restricting access to the receptacle. The toy is receivable in the receptacle when the door is in the open position. In one implementation, the circulation mechanism is inoperable when the door is in the open position.

In one embodiment, a tray is movably coupled to the base and configured to retain a plurality of the particles. The particles are drawn upwardly from the tray and expelled into the receptacle via the circulation mechanism during operation. In one implementation, the circulation mechanism is in between the tray and the receptacle.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length,"

"width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
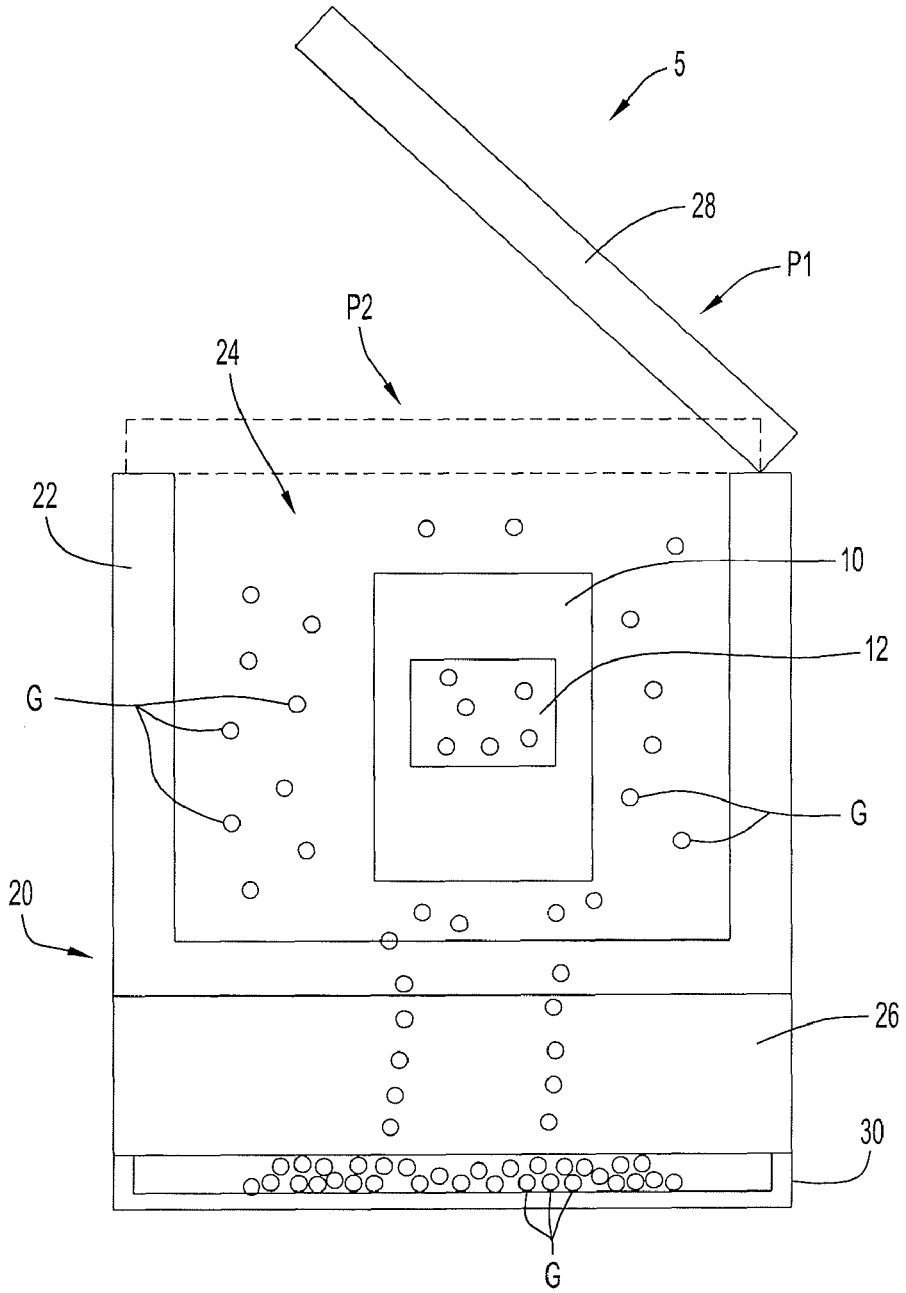
FIG. 1 illustrates a schematic diagram of a playset according to an embodiment of the present invention.

FIG. 1 illustrates a schematic diagram of a playset 5 according to an embodiment of the present invention. Playset 5 includes a toy 10 including at least one adhesive surface portion 12, and an apparatus 20 for circulating particle material, such as glitter particles G. The apparatus 20 includes a housing 22 defining a receptacle 24. The receptacle 24 is configured to removably receive the toy 10 therein. A circulation mechanism 26 is coupled to the housing 22, and is in communication with the receptacle 24. The circulation mechanism 26 is operable to circulate the particles G throughout the receptacle 24. At least a portion of the particles G are adherable to the adhesive surface portion 12 when the toy 10 is received in the receptacle 24 and the circulation mechanism 26 is operating.

In one embodiment, the apparatus 20 includes a door 28 pivotally coupled to the housing 22. The door 28 is movable between an open position P1 allowing access to the receptacle 24 and a closed position P2 (shown in phantom) restricting access to the receptacle 24. The toy 10 is receivable in the receptacle 24 when the door 28 is in the open position P1.

In one embodiment, the apparatus 20 also includes a tray or storage component or compartment 30 coupled to the housing 22 and configured to retain a plurality of the particles G. During operation, the circulation mechanism 26 draws the particles G upwardly from the tray 30, and expels the particles G into the receptacle 24. The particles G are then circulated throughout the receptacle 24, thereby contacting the toy 10. In one embodiment, the circulation mechanism 26 is disposed in between the tray 30 and the receptacle 24.

Figure 2:
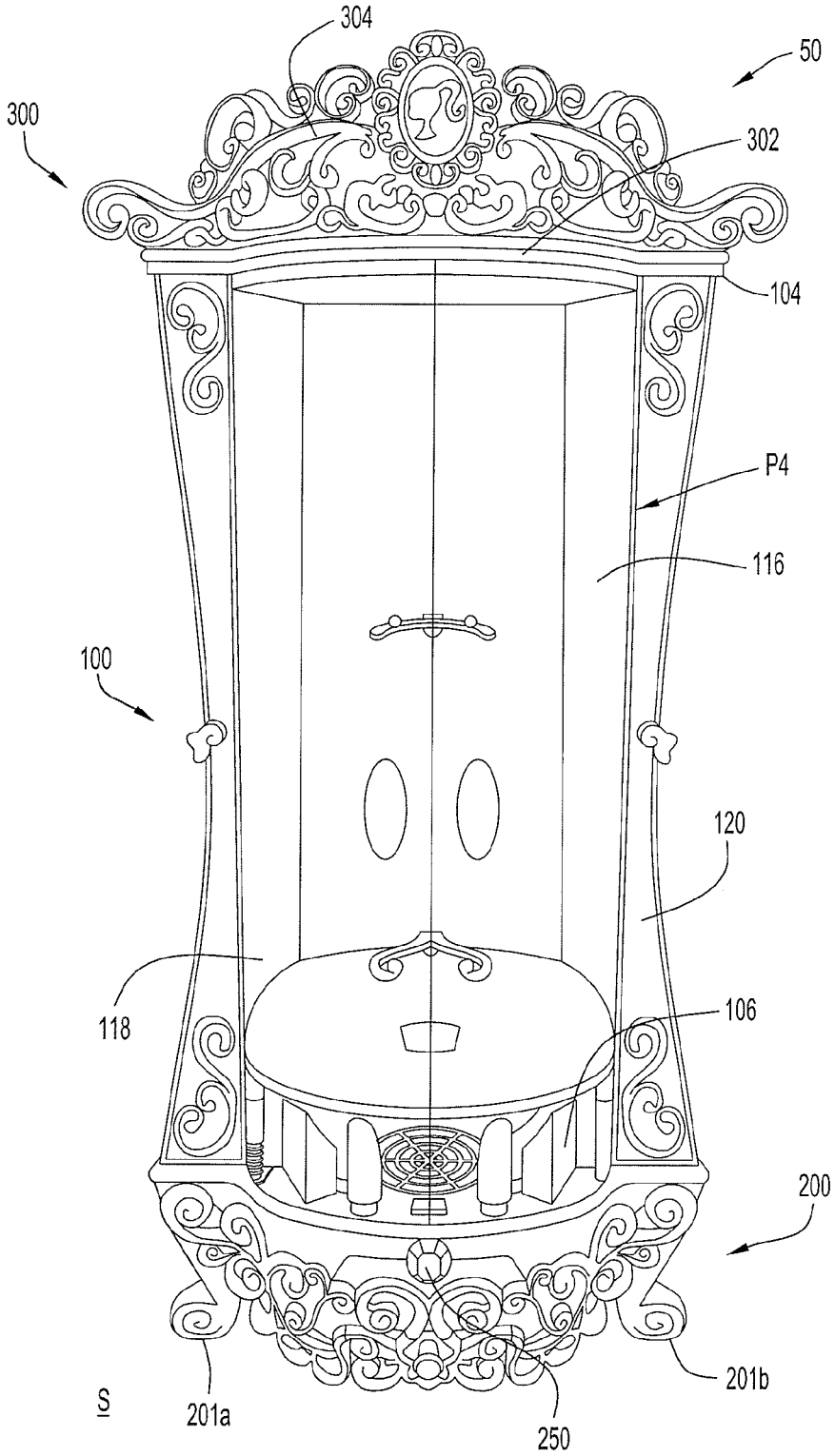
FIG. 2 illustrates a front perspective view of an apparatus for circulating glitter particles according to another embodiment showing a door of the apparatus in a closed position.
Figure 3:
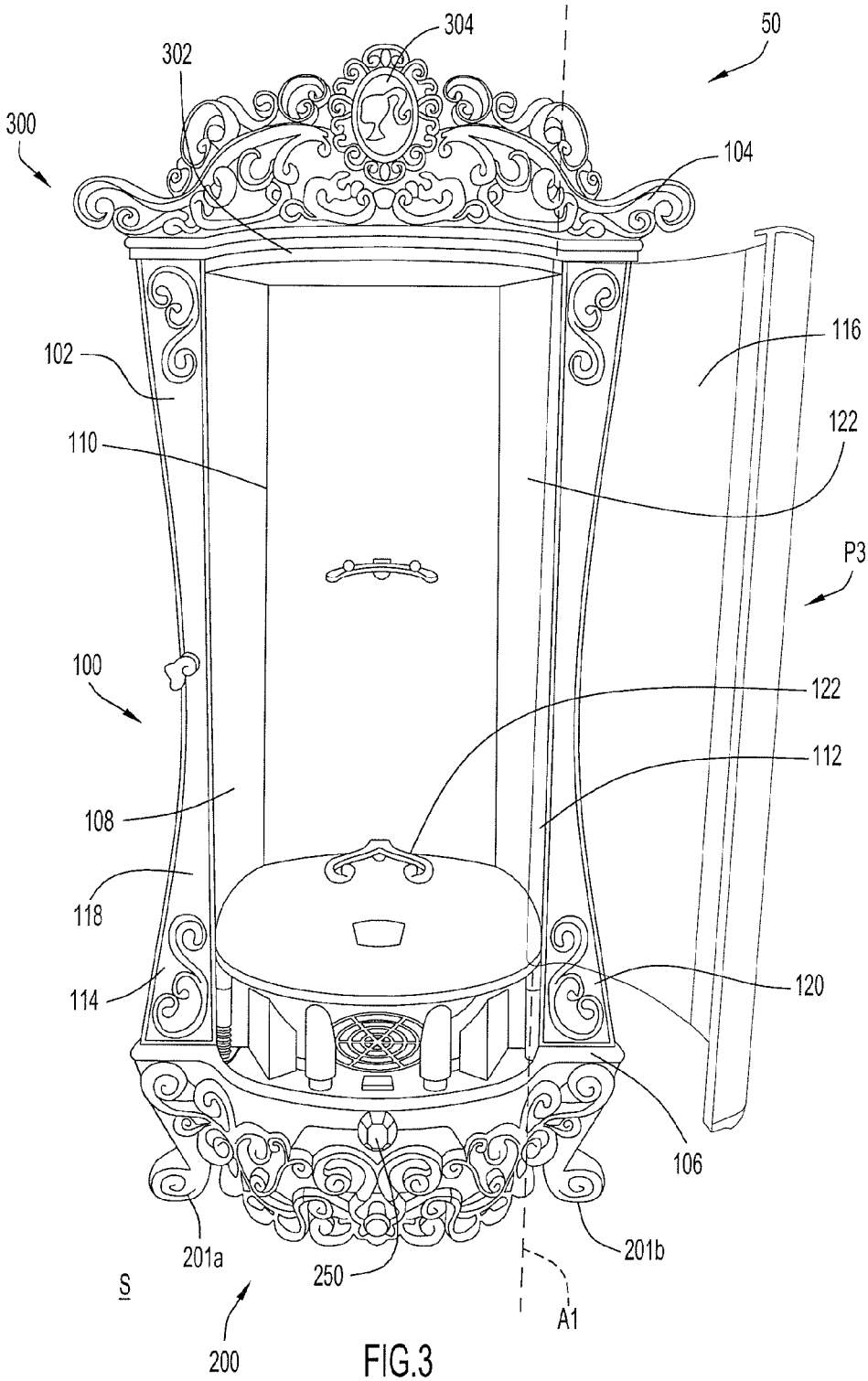
FIG. 3 illustrates another front perspective view of the apparatus of FIG. 2 showing the door in an open position.
Figure 4:
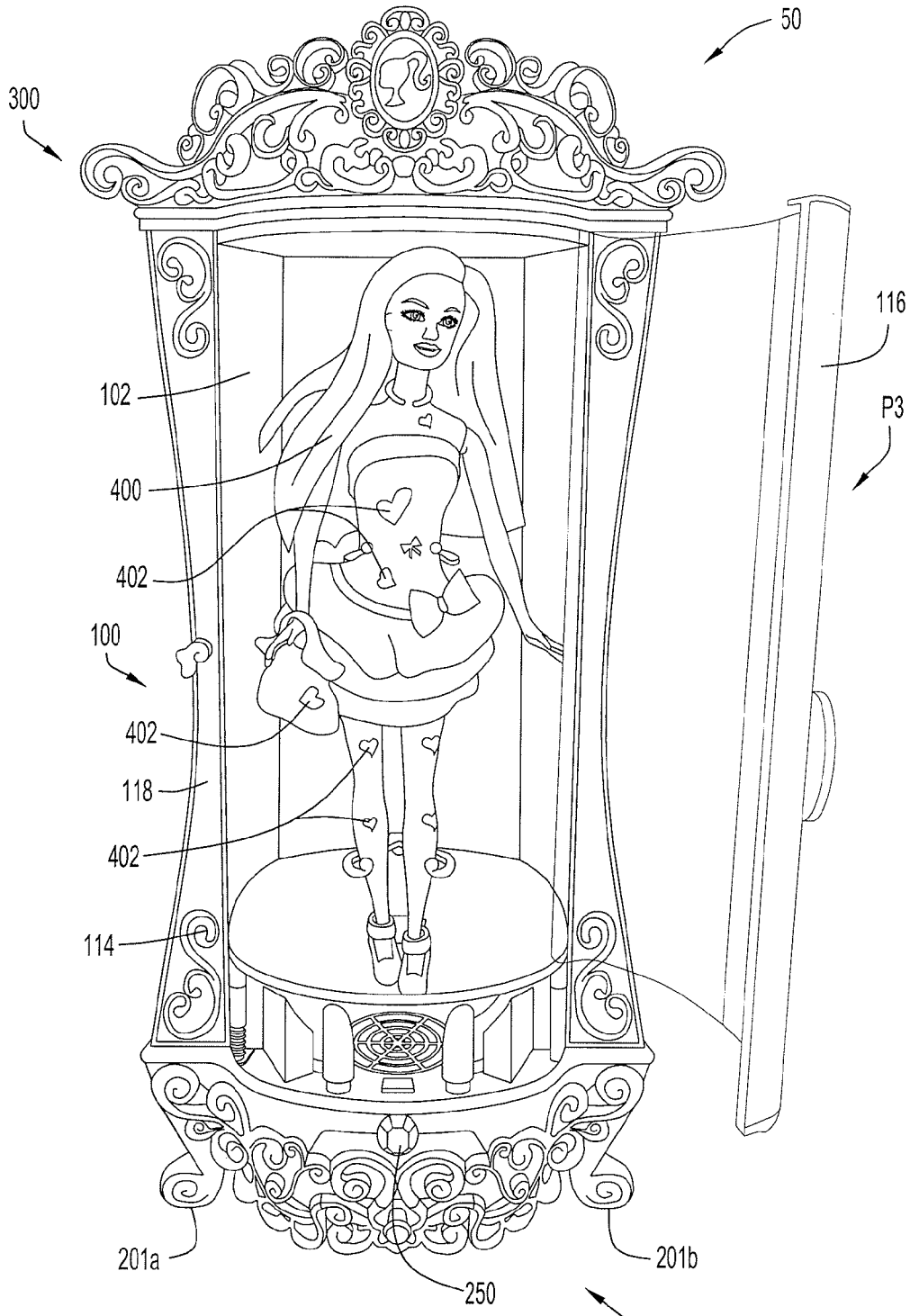
FIG. 4 illustrates another front perspective view of the apparatus of FIG. 2 showing a doll in a chamber and the door in its open position.

An apparatus 50 for circulating glitter particles G according to another embodiment is illustrated in FIGS. 2, 3 and 4. The apparatus 50 includes a central body assembly 100, a base assembly 200, and a top assembly 300. The central body assembly 100 defines a chamber 102 configured to receive a toy, such as a doll 400, as shown in FIG. 4.

With continued reference to FIGS. 2 and 3, the central body assembly 100 includes opposing end portions 104, 106, and a wall portion 108 extending between and connected to the end portions 104, 106. The end portions 104, 106 and the wall portion 108 collectively define the chamber 102. Further, the wall portion 108 includes opposing side edges 110, 112, shown in FIG. 3, that partially define an opening 114. The opening 114 is in communication with the chamber 102.

The central body assembly 100 further includes a door 116 that is pivotally coupled to and/or movable relative to the wall portion 108. In one embodiment, the door 116 is pivotal about an axis A1 (shown in FIG. 3) that is substantially parallel to a longitudinal axis of the chamber 102. The door 116 is movable between an open position P3 (shown in FIGS. 3 and 4) allowing access to the chamber 102 and a closed position P4 (shown in FIG. 2) restricting access to the chamber 102. As shown in FIG. 4, the doll 400 is receivable in the chamber 102 through the opening 114 when the door 116 is in its open position P3.

In one embodiment, the wall portion 108 includes an outwardly extending side buttress member 118 disposed proximate to side edge 110. Another outwardly extending side buttress member 120 is disposed proximate to side edge 112. The side buttress members 118, 120 provide additional support and rigidity to the central body assembly 100. Alternatively or in addition, the side buttress members 118, 120 provide aesthetic and decorative appeal to a child playing with the apparatus 50.

In one embodiment, the door 116 has a curved configuration, so that the door 116 and the wall portion 108 collectively have a substantially tubular or cylindrical configuration when the door 116 is in its closed position P4. Further, in one embodiment, the door 116 is substantially transparent or translucent, or includes transparent or translucent portions. In this way, the chamber 102 and/or the doll 400 is at least partially visible through the door 116, even when the door 116 is in its closed position P4.

The base assembly 200 includes a circulation mechanism (described in further detail below), which circulates glitter particles G (such as shown in FIG. 1) throughout the chamber 102. In one embodiment, the circulation mechanism is operable when the door 116 is in its closed position P4, and the circulation mechanism is inoperable when the door 116 is not in its closed position P4 (e.g. when the door 116 is in its open position P3).

During operation of the circulation mechanism, a least a portion of the glitter particles G contact the doll 400 and/or any other object in the chamber 102 as the particles G are circulated throughout the chamber 102. In one embodiment, the doll 400 (or other toy received within the chamber 102) includes one or more adhesive surface portions 402. At least a portion of the glitter particles G contact and adhere to the adhesive surface portion(s) 402 as the particles G are circulated throughout the chamber 102.

In one embodiment, each adhesive surface portion 402 is releasably securable to the doll 400 at a selected position. For example, the adhesive surface portions 402 may be configured as double-side adhesive stickers, which may be applied to the doll 400, the doll's clothing, and/or other accessories (e.g. jewelry, a purse, and/or shoes for the doll 400). The glitter particles G are then adhered to the exteriorly disposed adhesive surface of the stickers. The doll 400 and/or her clothing or accessories are coated with glitter in selected areas (for example, in heart shape patterned areas), providing a glamorous and re-stylized doll 400 that is appealing to a child. The appearance and/or outfit of the doll 400 may again be reconfigured by removing the glittered stickers (i.e. adhesive surface portions 402), adding additional adhesive surface portions 402, and/or by changing the position of one or more of the adhesive surface portions 402 on the doll 400.

Referring again to FIG. 3, in one embodiment, one or more retaining members, mechanisms or clips 122 are coupled to the central body assembly 100 and disposed within the chamber 102. The clips 122 are configured to releasably secure the doll 400 (or other toy) within the chamber 102, as shown in FIG. 4, thereby ensuring that the doll 400 (or other toy) remains in a substantially fixed position within the chamber 102. Alternative mechanisms may be employed which cooperate with the doll 400 (or other toy) in order to retain the doll 400 (or other toy) in a fixed position within the chamber 102. For example, the doll 400 (or toy) may be retained via magnets, ties, snaps, hook and loop fasteners, etc.

Referring to FIGS. 2 and 3, the top assembly 300 includes a lower portion 302 coupled to end portion 104 of the central body assembly 100. In one embodiment, an upper end of the chamber 102 is enclosed by or defined by the lower portion 302 of the top assembly 300. The top assembly 300 may include a decorative portion 304 stylized to resemble the top of a wardrobe.

The base assembly 200 is coupled to end portion 106 of the central body assembly 100. The base assembly 200 may include feet or legs 201*a*, 201*b* configured to engage a support surface S. The legs 201*a*, 201*b* may help to stabilize the apparatus 50 on the support surface S in an upright position.

Figure 5:
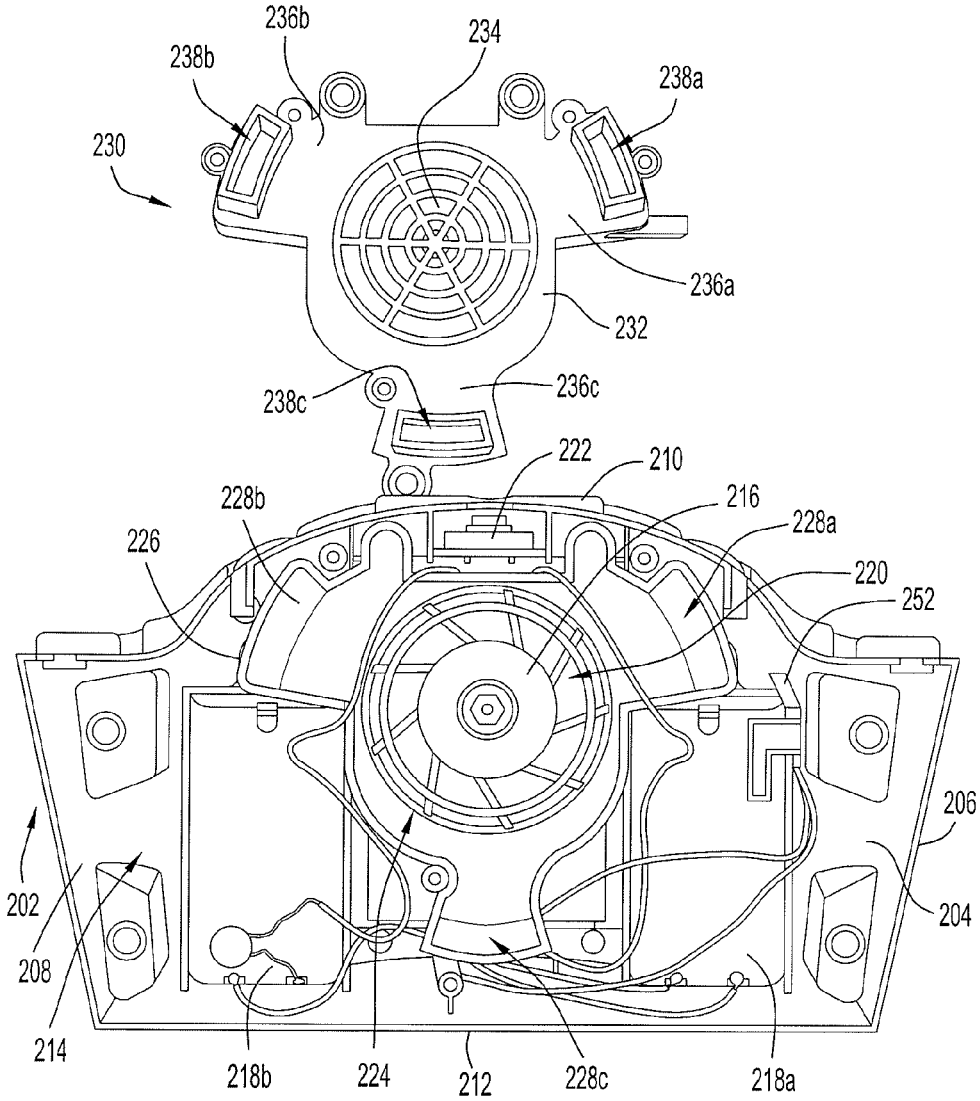
FIG. 5 illustrates a top perspective assembly view of components of the base assembly of the apparatus of FIG. 2 showing a circulation mechanism disposed in a recess of the base assembly.

Referring to FIG. 5, the base assembly 200 includes a housing member 202 having a bottom portion 204, opposing sidewall portions 206, 208, a front wall portion 210, and a rear wall portion 212. The sidewall portions 206, 208, front wall portion 210, and rear wall portion 212 extend upwardly from the bottom portion 204, and collectively define a recess 214.

A circulation mechanism, such as a fan 216, is coupled to the housing member 202 and disposed within the recess 214. The fan 216 includes an associated motor that is electrically coupled via associated wiring to a power source, such as batteries (not shown) disposed within battery compartments 218*a*, 218*b*. The fan 216 includes rotatable blade members 220, and directs a current of air outwardly from the blade members 220 and into the chamber 102 during operation thereof. The fan 216 is activated via an on/off switch 222 electrically coupled thereto.

In one embodiment, the fan 216 is seated within a cavity 224 defined by a casing 226 received within the recess 214. The casing 226 further defines pockets 228*a*, 228*b*, 228*c* adjacent and in communication with the cavity 224.

A cover plate 230 having a configuration corresponding to the footprint of the casing 226 is coupled thereto. Accordingly, the cover plate 230 includes a central portion 232 configured to cover or encase the cavity 224, and thus the fan 216 within the cavity 224. The central portion 232 includes a plurality of openings or a screen portion 234, which is aligned with the fan 216. Further, the cover plate 230 includes arms 236*a*, 236*b*, 236*c* coupled to and extending outwardly from the central portion 232, and configured to cover or encase the pockets 228*a*, 228*b*, 228*c*, respectively. Arm 236*a* includes an opening 238*a* in communication with pocket 228*a*. Similarly, arm 236*b* includes an opening 238*b* in communication with pocket 228*b*, and arm 236*c* includes an opening 238*c* in communication with pocket 228*c*.

Figure 5A:
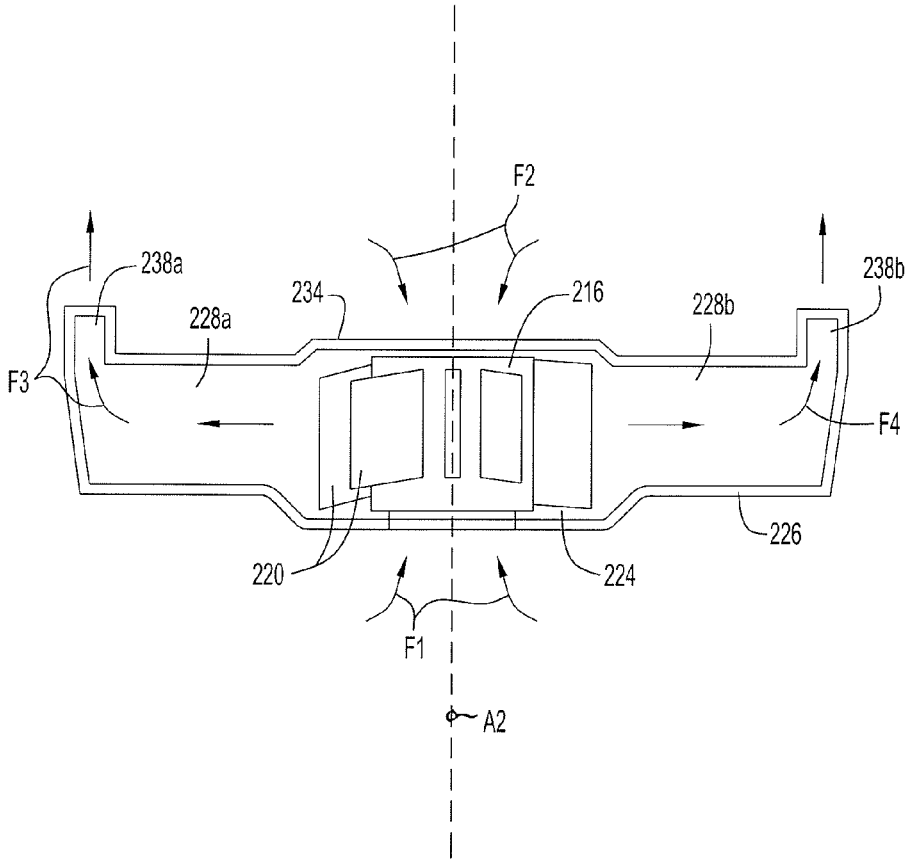
FIG. 5A illustrates a side sectional view of the circulation mechanism of FIG. 5.

Referring to FIG. 5A, air is pulled upwardly through an associated screen (not shown) toward the fan 216, as shown by arrows F1, and downwardly through the screen portion 234 toward the fan 216, as shown by arrows F2. An inwardly directed air current aligned with or parallel to an axis of rotation A2 of the fan 216 is generated as the blade members 220 are rotated. The air is then pushed away from the blade members 220 and outwardly from the axis of rotation A2 thereof, as shown by arrows F3, and F4. The air is pushed away from the blade members 220 and into the pockets 228*a*, 228*b*, 228*c*, and then outwardly from the pockets 228*a*, 228*b*, 228*c* and through the associated openings 238*a*, 238*b*, 238*c*. The air is expelled from the openings 238*a*, 238*b*, 238*c* and into the chamber 102. Thus, the air current is circulated inwardly toward the fan 216 and then outwardly through pockets 228*a*, 228*b*, 228*c* and into the chamber 102.

Figure 6:
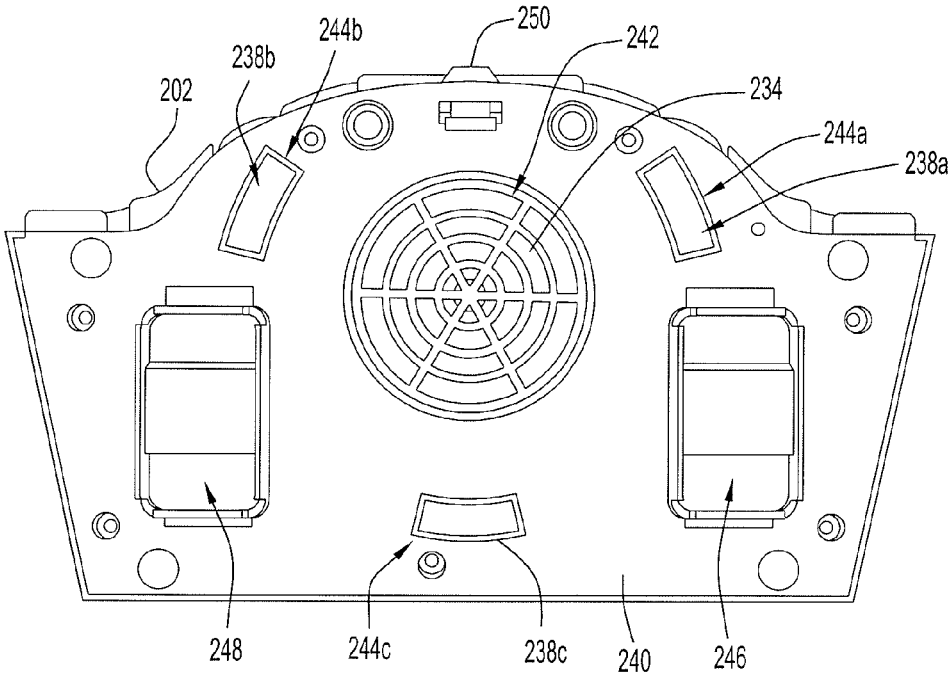
FIG. 6 illustrates a top perspective view of the base assembly of the apparatus of FIG. 2.

Referring to FIG. 6, a housing cover 240 is coupled to the housing member 202 (shown in FIG. 5), thereby covering or encasing the casing 226, fan 216 and the cover plate 230 within the recess 214. The housing cover 240 includes an opening 242 that aligns with the screen portion 234 and thus the fan 216, so that the inwardly directed air flow F2 to the fan 216 is not blocked. The housing cover 240 also includes openings 244*a*, 244*b*, 244*c* aligned with the openings 238*a*, 238*b*, 238*c*, respectively. Thus, the pockets 228*a*, 228*b*, 228*c* are in communication with the chamber 102, and an air flow (e.g. air flow F3 and F4) is permitted therebetween.

The housing cover 240 also includes receiving wells 246, 248 configured to receive correspondingly configured engaging members (not shown) extending outwardly from the end portion 106 of the central body member 100. A push button 250 is movably coupled to the front wall portion 210 of the housing member 202. The push button 250 is aligned with the switch 222. Depression of the push button 250 activates the switch 222, thereby turning the associated motor of the fan 216 on or off. Note that push button 250 is also illustrated in FIGS. 2-4.

Figure 7:
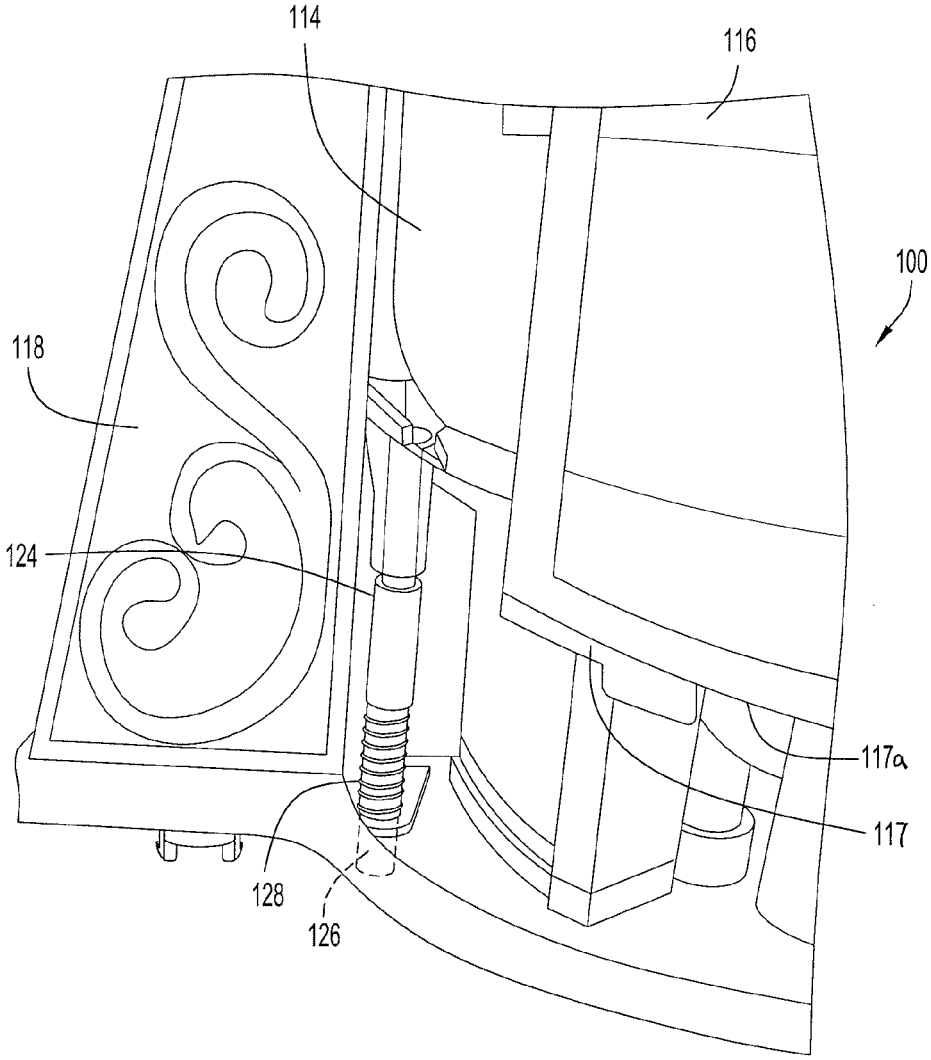
FIG. 7 illustrates a perspective fragmentary view of portions of the central body assembly of the apparatus of FIG. 2.

Referring to FIG. 7, in one embodiment, the central housing portion 100 includes a slide member 124 disposed proximate to the opening 114 and engageable with a cam surface 117 coupled to a lower edge 117*a* of the door 116 when the door 116 is in its closed position P4 (shown in FIG. 2). When engaged by the cam surface 117, the slide member 124 is forced downwardly toward the base assembly 200. When the door 116 is in its fully closed position P4, a distal end 126 (shown in phantom) of the slide member 124 is forced downwardly by the cam surface 124 so that the distal end 126 engages a contact 252 (shown in FIG. 5). If the door 116 is not in its fully closed position P4, the slide member 124 is biased upwardly and away from the contact 252 via a resilient member such as a compression spring 128.

The contact 252 is electrically coupled via associated wiring to the fan 216, so that the fan 216 is operable when the contact 252 is engaged by the slide member 124 and inoperable when the contact 252 is not engaged by the slide member 124. In this way, the fan 216 is operable when the door 116 is in its fully closed position P4, but inoperable when the door 116 is not in its fully closed position (e.g. when in its open position P3). Thus, the glitter particles G are not undesirably circulated or expelled from the chamber 102 when the door 116 is in its open position P3 (or otherwise not in its fully closed position P4). The slide member 124 and contact 252 thereby act as a safety switch, rendering the fan 216 inoperable unless the door 116 is properly closed.

Figure 8:
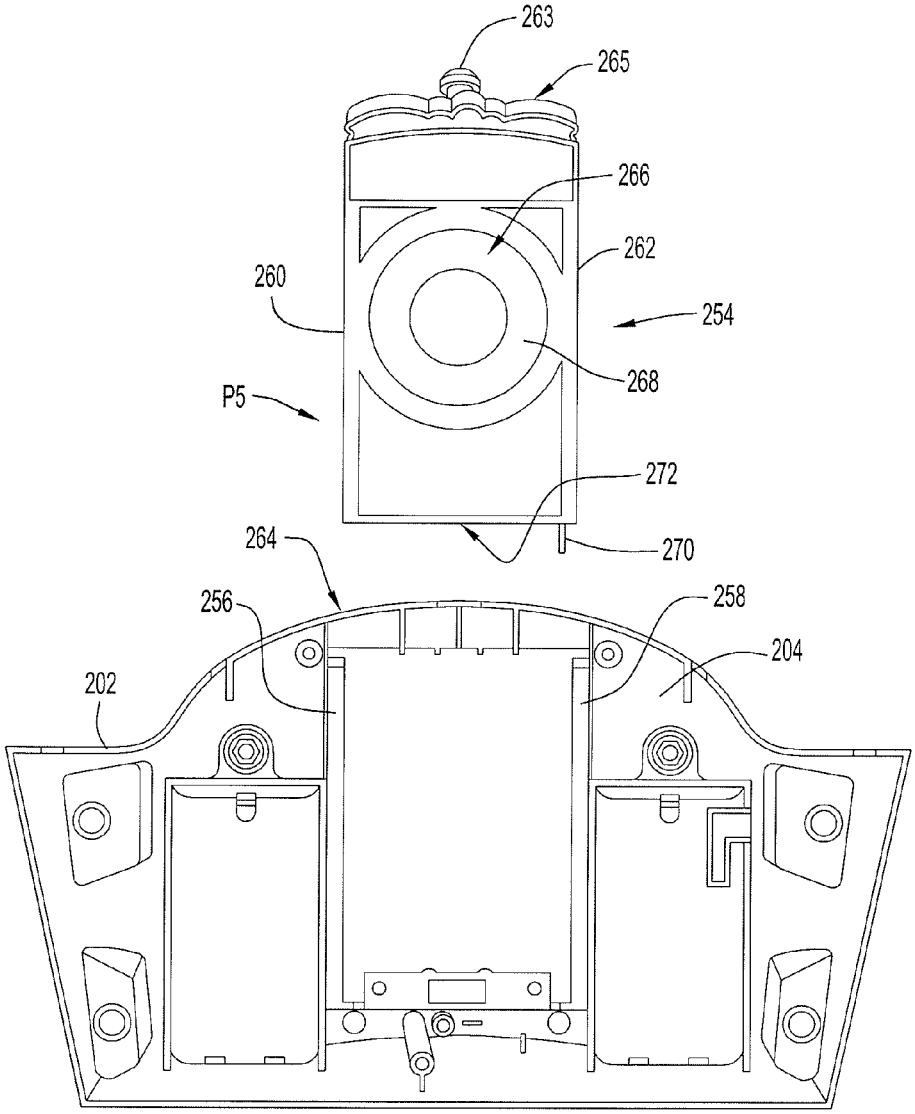
FIG. 8 illustrates another top perspective view of other components of the apparatus of FIG. 2 showing a tray in an open position.
Figure 9:
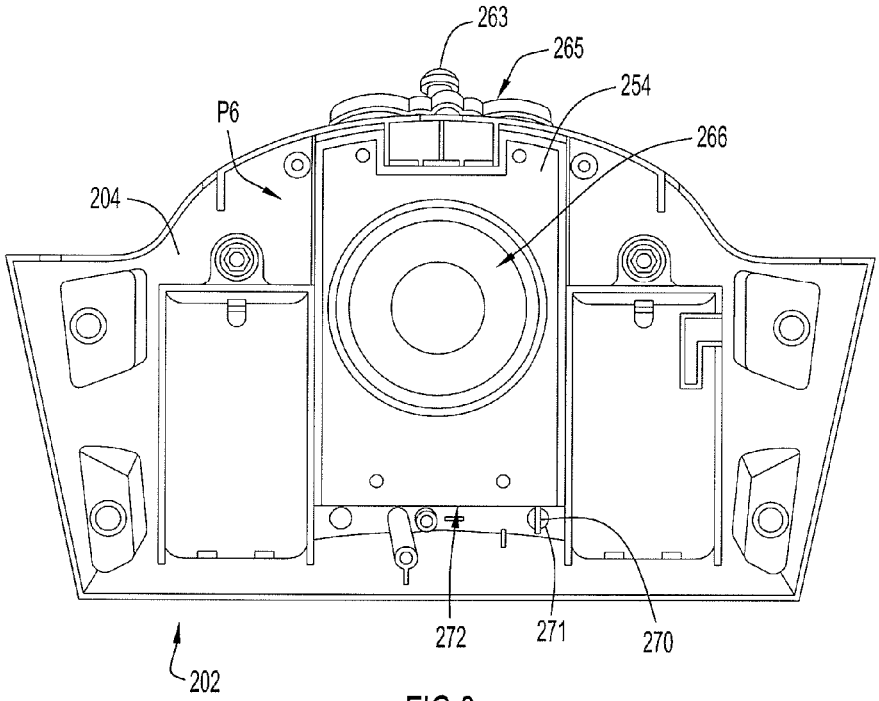
FIG. 9 illustrates another top perspective view of the components shown in FIG. 8 showing the tray in a closed position.

Referring to FIGS. 8 and 9, in one embodiment, the base assembly 200 further includes a tray 254 coupled to the housing member 202. The tray 254 is configured to hold a plurality of glitter particles G. The tray 254 is movable between an open position P5 (shown in FIG. 8) that is spaced from the fan 216, and a closed position P6 (shown in FIG. 9) that is in communication with the fan 216. In the closed position P6, glitter particles G disposed in the tray 254 are drawn upwardly by the fan 216, expelled outwardly through the pockets 228*a*, 228*b*, 228*c*, and then out through the openings 238*a*, 238*b*, 238*c* and into the chamber 102. The glitter particles G are then circulated throughout the chamber 102 via continued operation of the fan 216, as described above and as shown in FIG. 5A.

In one embodiment, the tray 254 is slidably coupled to the housing member 202. The bottom portion 204 of the housing member 202 includes tracks 256, 258 along which opposing side edges 260, 262 of the tray 254 slide, similar to a drawer. The tray 254 may include a knob or pull 263 extending outwardly from a front end 265 thereof. The tray 254 is slidably received through an opening 264 in the front wall portion 210, and engages the tracks 256, 258. In one embodiment, the tray 254 may be detached from the housing member 202 (as shown in FIG. 8). In other embodiments, the tray 254 includes a stop (not shown) restricting detachment of the tray 254 from the housing member 202.

The tray 254 includes a basin 266 configured to hold a plurality of the glitter particles G. In one embodiment, the basin 266 includes a raised center portion 268, so that the glitter particles G retained in the basin 266 tend to collect in a donut-shaped configuration therein. In this configuration, the glitter particles G are more easily directed upwardly by the fan 216 and against the blade members 220, given the blade members 220 are likewise oriented in a donut-shaped array about their axis of rotation A2. The glitter particles G are drawn upwardly by the blade members 220 and then expelled into the pockets 228*a*, 228*b*, 228*c*, as described above.

In one embodiment, the fan 216 is disposed in between and substantially axially aligned with the basin 266 and the chamber 102 when the tray 254 is in its closed position P6. Thus, the axis of rotation A2 of the fan 216 is substantially co-axial with or parallel to the longitudinal axis of the chamber 102. In other embodiments, the fan 216 may be offset from the basin 266 and/or the longitudinal axis of the chamber 102. For example, tubing or chutes may be provided through which the glitter G is directed via a circulation mechanism.

With continued reference to FIGS. 8 and 9, in one embodiment, the tray 254 includes a projection 270 extending outwardly from a rear end 272 thereof. When the tray 254 is disposed in its fully closed position P6 (shown in FIG. 9), the projection 270 engages a contact 271 that is electrically coupled to the fan 216 via associated wiring. Similar to the contact 252 associated with the slide member 124, the fan 216 is operable when the contact 271 is engaged by the projection 270 and inoperable when the contact 271 is not engaged by the projection 270.

Thus, in one embodiment, the fan 216 is only operable when the tray 254 is in its fully closed position P6, but inoperable when the tray 254 is not in its fully closed position P6. Thus, the possibility of debris or other items being drawn into or caught in the fan 216 when the tray 254 is in its open position P5 (or not properly closed) is minimized.

Thus, in one embodiment, the fan 216 is operable only when the door 116 is in its fully closed position P4, and also the tray 254 is in its fully closed position P6. The contacts 252, 271 and associated slide member 124 and projection 270 act as safety switches, rendering the fan 216 inoperable unless the door 116 and the tray 254 are both properly closed.

In an alternative embodiment, the storage compartment or tray may be pivotally coupled to the base or to the housing. In another embodiment, the location and quantity of clips or support members that retain the object, such as a doll, in a particular position in the chamber can vary.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An apparatus for circulating glitter particles, comprising:

a housing defining a chamber and an opening in communication with the chamber, the chamber configured to removably retain an object therein;

a door coupled to the housing and movable between an open position allowing access to the chamber and a closed position restricting access to the chamber, the object passable through the opening and receivable in the chamber when the door is in the open position;

a circulation mechanism in communication with the chamber and configured to circulate glitter particles throughout the chamber when the circulation mechanism is in operation; at least a portion of the glitter particles contact the object when circulated throughout the chamber; and wherein the object includes an adhesive surface portion, the glitter particles adherable to the adhesive surface portion as the glitter particles circulate throughout the chamber.

2. The apparatus of claim 1, further comprising:

a tray coupled to the housing and configured to retain a plurality of the glitter particles, the glitter particles moved from the tray and throughout the chamber via operation of the circulation mechanism.

3. The apparatus of claim 1, wherein the circulation mechanism is inoperable when the door is in the open position.

4. The apparatus of claim 1, further comprising:

a retaining mechanism coupled to the housing and disposed within the chamber, the retaining mechanism configured to releasably secure the object within the chamber.

5. A glitter circulation device, comprising:

a housing defining a chamber configured to receive a doll;

a storage compartment movably coupled to the housing and configured to hold a plurality of glitter particles;

a fan coupled to housing and in communication with the storage compartment and the chamber, the fan configured to draw the glitter particles from the storage compartment and expel the glitter particles into the chamber; wherein the storage compartment is slidably coupled to the housing and movable between an open position spaced from the fan and a closed position in communication with the fan.

6. The device of claim 5, wherein the housing defines an opening in communication with the chamber, and the device further comprises:

a door coupled to the housing and movable between an open position allowing access to the chamber and a closed position restricting access to the chamber, the doll removably receivable in the chamber through the opening when the door is in the open position.

7. The device of claim 6, further comprising a switch in communication with the fan, the fan operable when the switch is actuated and the fan inoperable when the switch is de-actuated, the switch actuated when the door is in the closed position and the switch de-actuated when the door is in the open position.

8. The device of claim 6, wherein the chamber has a longitudinal axis, and the door is pivotal about an axis that is substantially parallel to the longitudinal axis of the chamber.

9. The device of claim 5, wherein the fan is disposed in between the storage compartment and the chamber, and glitter particles drawn upwardly from the storage compartment and into the chamber and circulated throughout the chamber via operation of the fan.

10. The device of claim 5, wherein the fan is inoperable when the storage compartment is in the open position.

11. The device of claim 5, wherein the doll includes at least one adhesive surface portion, at least a portion of the glitter particles contacting and adhering to the adhesive surface portion when the glitter particles are circulated within the chamber via the fan.

12. A playset, comprising:

a toy including an adhesive surface portion;

a housing defining a receptacle configured to removably receive the toy; and a circulation mechanism coupled to the housing and in communication with the receptacle, the circulation mechanism operable to circulate particles throughout the receptacle, at least a portion of the particles adhering to the adhesive surface portion when the toy is received in the receptacle and the circulation mechanism is operating.

13. The playset of claim 12, further comprising:

a door pivotally coupled to the housing, the door movable between an open position allowing access to the receptacle and a closed position restricting access to the receptacle, the toy receivable in the receptacle when the door is in the open position.

14. The playset of claim 13, wherein the circulation mechanism is inoperable when the door is in the open position.

15. The playset of claim 12, further comprising a tray movably coupled to the base and configured to retain a plurality of the particles, the particles drawn upwardly from the tray and expelled into the receptacle via the circulation mechanism during operation.

16. The playset of claim 15, wherein the circulation mechanism is in between the tray and the receptacle.

17. The playset of claim 12, wherein the adhesive surface portion is releasably securable to the toy at a selected position.

* * * * *